US005087216A

United States Patent [19]

Noggle

[11] Patent Number: 5,087,216

[45] Date of Patent: Feb. 11, 1992

[54] FISHERMAN'S MARKER BUOY WITH INTEGRAL REEL

[76] Inventor: Edward F. Noggle, 1926 E. La Veta, #105, Orange, Calif. 92666

[21] Appl. No.: 663,573

[22] Filed: Mar. 1, 1991

[51] Int. Cl.[5] ..... B63B 22/18

[52] U.S. Cl. ..... 441/26

[58] Field of Search ..... 441/1, 6, 23-26; 43/43.1, 43.11, 44.87; 242/107

[56] References Cited

U.S. PATENT DOCUMENTS 4,778,422 10/1988 Saulnier ..... 441/26

4,781,636 11/1988 Schurr ..... 441/6

*Primary Examiner*—Jesûs D. Sotelo

*Attorney, Agent, or Firm*—William L. Chapin

[57] ABSTRACT

A marker buoy adapted to be held in the hand and thrown on the surface of a body of water to mark a location beneath the surface comprises a thin, hollow, water-tight box with a concentric aperture through the thickness dimension of the box. The box is constructed of upper and lower concave shells which are mirror symmetric through the medial transverse plane of the box, where the two shells are bonded to one another. Recesses formed between internal walls within the shells hold a reel assembly have a take-up spool located in the aperture, and a crankshaft fitted with a handle protruding through a side of the box. A flexible cord is attached to the take-up spool and wound around the spool by turning the crankshaft handle. The other end of the cord is attached to an anchor weight.

14 Claims, 1 Drawing Sheet

FISHERMAN'S MARKER BUOY WITH INTEGRAL REEL

BACKGROUND OF THE INVENTION

A. Field of the Invention

The present invention relates to articles for use in commercial and sport fishing. More particularly, the invention relates to small buoys used to mark the location of desirable fishing locations.

B. Background of the Invention

Commercial or sport fishermen on lakes or other relatively shallow waters oftentimes find it desirable to mark good fishing locations. Thus, locations beneath the surface of a river, lake or other body of water at which fish have been spotted or are likely to be found, may be discovered by the use of sonar echoes, or by other means. When desirable "holes" or other prospective locations for fish have thus been discovered, it is sometimes desirable to mark such locations, to allow time for a moving boat to return to the locations.

One method of marking such sub-surface locations is to drop small marker buoys at the locations. Typical marker buoys commonly used for such purposes have a buoyant plastic body. A length of flexible cord is attached to the body, and a weight attached to the other end of the cord. The body usually has a groove or space for holding the wound cord.

A number of prior art patents disclose devices usable as marker buoys of the type described above, or are related to marker buoys. Those prior art patents which the present inventor is aware of consist of the following U.S. Pat. Nos.:

Wilson, 584.615, June 15, 1957, Fishing Tackle Float.

Turner, 2,860,442, Nov. 18, 1958, Bobbers With Water-Released Line Casting Reels.

Hamm, 3,089,156, May 14, 1963, Marking Buoy.

Laird, 3,162,870, Dec. 29, 1964, Anchor Light.

Johnson, 4,501,563, Feb. 26, 1985, Marker Buoy.

Saulnier, 4,778,422, Oct. 18, 1988, Buoy For Storing Rope Connected To An Underwater Article.

Each of the devices disclosed in the references cited above, except the Johnson patent, employs a reel for containing a cord or string attached to a weight. The Johnson patent discloses a marker buoy made of two pontoon-like side members, joined by a central rectangular section for holding a length of cord attached to a weight.

In some applications for fishermen's marker buoys, a substantial number of buoys are dropped at various locations from a rapidly moving boat, as sonar systems in the boat identify desirable sub-surface locations, or schools of fish. Because of the time and effort required to rewind the weight cord on a buoy when the buoy is retrieved, it would be desirable to provide means for more rapidly and conveniently rewinding the cord. However, because of the large number of buoys which are sometimes deployed, and the possibility of losing some buoys when a large number are distributed over a wide area, it would be desirable to provide a fisherman's marker buoy having an integral cord tale-up reel, facilitating rapid rewinding of a weight cord, yet being of a simplified design and construction which permits manufacturing the marker buoy at a low cost.

OBJECTS OF THE INVENTION

An object of the present invention is to provide a fisherman's marker buoy adapted to being cast upon a body of water, and unwinding a length of cord joining a weight to a buoyant portion of the buoy.

Another object of the invention is to provide a fisherman's marker buoy having means permitting convenient rewinding of a cord and attached weight to the buoy.

Another object of the invention is to provide a fisherman's marker buoy having a reel which permits a weight and cord to be rapidly unwound by the force of gravity acting on the weight, and which facilitates rapid re-winding of the cord onto the reel.

Another object of the invention is to provide a fisherman's marker buoy incorporating an integral reel and having a minimum number of parts.

Another object of the invention is to provide a fisherman's marker buoy having an integral reel, of inherently low-cost and rugged construction.

Various other objects and advantages of the present invention, and its most novel features, will become apparent to those skilled in the art by perusing the accompanying specifications, drawings and claims.

It is to be understood that although the invention disclosed herein is fully capable of achieving the objects and providing the advantages described, the characteristics of the invention described in this specification are merely illustrative of the preferred embodiment. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved fisherman's marker buoy, of the type having a buoyant float attached to an anchor weight by a length of cord. The improved fisherman's marker buoy according to the present invention has in external appearance the shape of a thin rectangular box with a concentric rectangular aperture extending through the height or thickness dimension of the box. The box is constructed of upper and lower concave half sections which are substantially mirror symmetric about a transverse horizontal center plane of the box. The upper and lower half sections contain recesses for holding the axle or shaft of a reel assembly, the shaft lying in the horizontal center plane of the box, perpendicular to front and rear long side walls of the box. The reel assembly has a take-up spool which lies symmetrically in the central aperture of the box when the shaft of the reel assembly is placed in recesses in the upper and lower box half sections. The latter are bonded together to form a water-tight, hollow buoyant box after the reel assembly is installed in the recesses provided for it. A winding handle is attached to an end of the reel assembly shaft which protrudes through the front wall of the box.

A length of cord attached at one end to an anchor weight is attached at the opposite end of the cord to the take-up spool. The winding handle is turned to wind the cord unto the take-up spool. The buoy is used by casting it onto the surface of a body of water at a desired location, the force of gravity on the anchor weight causing the anchor weight cord to unwind from and rotate the reel shaft. Upon retrieving the marker buoy, the reel handle is used to rewind the weight cord on the spool assembly.

DETAILED DESCRIPTION OF THE INVENTION

Referring now to FIGS. 1 through 4, a fisherman's marker buoy according to the present invention is shown.

Figure 1:
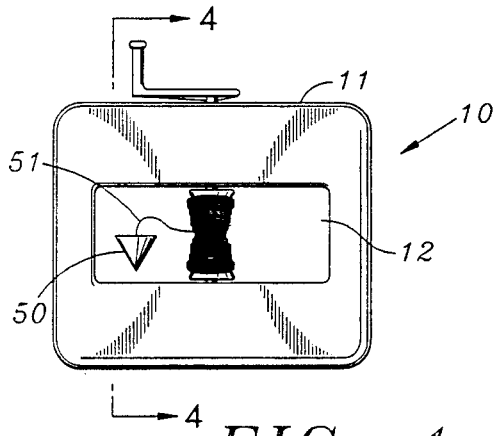
FIG. 1 is an upper plan view of the fisherman's marker buoy according to the present invention.
Figure 2:
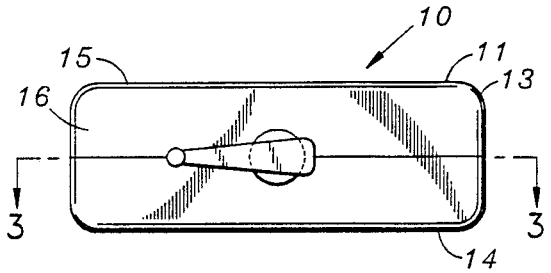
FIG. 2 is a side elevation view of the device of FIG. 1, on a somewhat enlarged scale.
Figure 3:
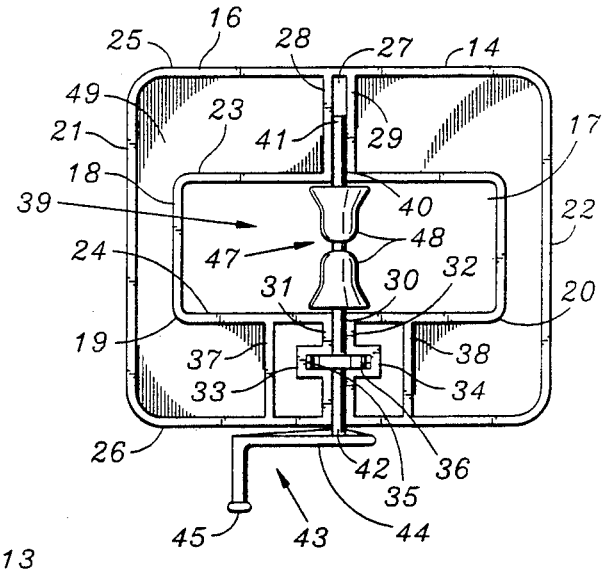
FIG. 3 is an upper transverse sectional view of the device of FIG. 2, taken along line 3—3 of FIG. 2.
Figure 4:
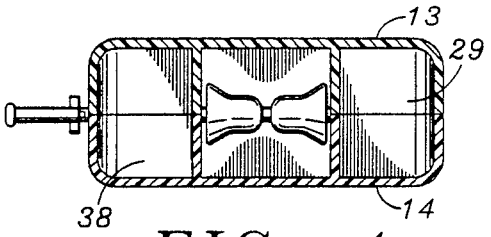
FIG. 4 is a longitudinal sectional view of the device of FIG. 1, taken along line 4—4 of FIG. 1.

As shown in FIGS. 1 and 2, the marker buoy 10 has the external appearance of a thin, rectangular box 11 having a concentric rectangular aperture 12 extending completely through the thickness dimension of the box. As may be seen best by referring to FIGS. 3 and 4, box 11 is hollow, consisting of mating, mirror symmetric concave upper half and lower half cover sections 13 and 14, respectively. Upper and lower cover sections 13 and 14 are made of a light, durable, water resistant plastic such as polypropylene. As shown in FIGS. 2 and 3, each cover section 13 or 14 has a rectangular plan view shape, a flat outer surface 15, and a flange or skirt 16 which extends perpendicularly inwards from the perimeter of the cover section, forming the outer wall thereof. A rectangular opening 17 extends concentrically through cover section 13 or 14. A flange or skirt 18 extends perpendicularly inwards from the outer wall surface 15 of cover section 13 or 14, around the perimeter of opening 17, forming the inner wall of the cover section. Flange 18 includes short front and rear sections 19 and 20 parallel to short front and rear legs 21 and 22, respectively of outer wall flange 16 of cover sections 13 or 14.

Box 10 includes channel structures for supporting a reel assembly, as will now be described. As shown in FIG. 3, flange 18 also has longer left and right side sections 23 and 24, respectively, parallel to the left and right sides 25 and 26 of outer wall flange 16. Left side inner wall flange section 23 has midway along its length a laterally disposed channel 27 extending perpendicularly between it and the parallel outer left side wall section 25. Channel 27 is formed by adjacent transversely disposed front and rear channel wall sections 28 and 29 which extend perpendicularly outwards from inner left side wall 23 to outer left side channel section 25. Thus, channel 27 extends perpendicularly outwards from center aperture 17 of box 11, to outer left side wall section 25.

Channel 27 lies in a transverse bisecting plane of box 10, equidistant between front wall 21 and rear wall 22 of the box.

Similarly, box 10 has a channel 30 axially aligned with channel 27 which extends outwards from right inner side wall 24 to right outer side wall 26. Channel 30 is formed between adjacent transversely disposed front and rear channel wall sections 31 and 32 which extend perpendicularly outwards from inner right wall section 24 to outer right wall section 26. Right channel wall sections 31 and 32 are axially aligned with left channel wall sections 28 and 29, respectively. However, rather than being straight, as are left channel wall sections 28 and 29, right channel wall sections 31 and 32 have adjacent U-shaped bends 33 and 34. Bends 33 and 34 form opposed, longitudinally aligned channels 35 and 36 perpendicular to channel 30, intermediate opposite lateral ends of channel 30. Box 10 preferably includes front and rear strengthening rib sections 37 and 38 which are positioned forward of and parallel to front right channel wall 31, and rearward of and parallel to rear right channel wall 32, respectively. Channels 27, 30, 35 and 36 are used to support a reel assembly 39 between upper cover section 13 and lower cover section 14 of box 11 of buoy 10, as will now be described.

Referring now to FIGS. 1 through 4, but especially to FIG. 3, a reel assembly 39 is shown rotatably supported within lower cover section 14 of buoy 10. Reel assembly 39 is preferably injection molded in one piece from a durable plastic such as ABS, styrene, or polypropylene. As shown in FIG. 3, reel assembly 39 includes a central circular axle, or shaft 40, of the proper diameter to fit snugly, but rotatably within the transversely disposed, axially aligned channels 27 and 30 situated midway between front wall 21 and rear wall 22 of lower cover section 14 of buoy 10. Shaft 40 of reel assembly 39 has a first, left-hand end 41 which fits into channel 27. A second, right-hand end 42 fits into right hand channel 30. A crank handle 43 is provided on the outer end of shaft portion 42. Crank handle 43 has an arm 44 connected to shaft end 42. Arm 44 lies parallel to and exterior of right-hand wall 26 of box 10. A handle 45 extends perpendicularly outwards from the end of arm 44 furthest away from shaft 42, parallel to and offset from the shaft.

Axle shaft 40 is held in a fixed lateral position in box 11 of buoy 10 by means of a disk-shaped boss 46 integral with right-hand axle shaft 42. Boss 46 lies partly in front longitudinally disposed channel 35 and partly in rear longitudinally disposed channel 36.

Reel assembly 39 includes a spool assembly 47 located in aperture 17, symmetrically positioned between left-hand inner wall section 23 and right-hand inner wall section 24. Spool assembly 47 consists of two integral bell-shaped bosses 48 positioned coaxially on shaft 40, with the smaller upper ends of the bosses adjacent one another and spaced slightly apart from a longitudinal central plane of box 10.

With reel assembly 39 inserted into either lower half section 14 of box 10, as shown in FIG. 3, or in upper half section 13, the opposite half section is then conformally mated with the half section containing the reel assembly. The entire length of outer flange wall 16 of upper half section 13 is then bonded to the corresponding outer flange wall of lower half section 14 to form a water-tight seal. Preferably, bonding is performed by ultrasonic welding, although adhesive bonding or any other suitable means may be used.

Similarly, the entire length of inner flange wall 18 of upper half section 13 is bonded to the corresponding inner flange wall of lower half section 14.

With the two aforementioned bonds having been made, a hollow, water-tight interior space 49 is formed between upper cover half section 13 and lower cover half section 14. Thus, buoy 10 is made sufficiently buoyant to float on the surface of water, with an anchor weight 50 and cord 51 wound on reel assembly 39.

Buoy 10 is used by casting it upon a body of water. Weight 50 is then pulled down by the force of gravity, unwinding cord 51 from spool assembly 47. When buoy 10 is retrieved, crank handle 43 is turned to re-wind cord 51 onto spool assembly 47.

What is claimed is:

1. A marker buoy comprising:

a. a buoyant body having an aperture therethrough, said buoyant body comprising hollow, concave upper and lower shell sections which are bonded together to form a water-tight structure, b. a reel assembly rotatably fastened to said body, said reel assembly having a spool located within said aperture and adapted for winding and unwinding a flexible cord thereon, c. a crank shaft attached to said spool, said crank shaft having an outer portion which protrudes exteriorly from said body, and d. a handle attached to said outer portion of said crank shaft for rotating said crank shaft and said spool.

2. The marker buoy of claim 1 wherein said upper and lower shell sections are substantially mirror symmetric through the plane in which they are joined together.

3. A marker buoy comprising;

a. upper and lower concave shell sections which are exteriorly mirror symmetric to one another, each of said shell sections having an outer face wall and an outer flange wall depending downwards from the perimeter of said outer face wall, said outer face wall having an aperture therethrough, the perimeter of which aperture has an inner flange wall depending downwardly from said outer face wall, the transverse edge surfaces of said outer and inner flange walls of said upper shell section being sealingly joined to corresponding transverse edge surfaces of said lower shell section, thereby forming a hollow, water-tight buoyant body, b. a reel assembly rotatably attached to said body, said reel assembly having a spool adapted for winding and unwinding a flexible cord attached to said spool assembly, and c. means for rotating said reel assembly, thereby winding said cord unto said spool assembly.

4. The marker buoy of claim 3 wherein said means for rotating said spool comprises a crankshaft attached to said spool, said crankshaft having an outer end which protrudes through an outer flange wall of said shell sections.

5. The marker buoy of claim 4 wherein said crankshaft is further defined as being an elongated straight cylindrical member.

6. The marker buoy of claim 5 wherein said spool is further defined as being an enlarged diameter member coaxially attached to said crankshaft, said enlarged diameter member being located intermediate the opposite transverse ends of said crankshaft.

7. The marker buoy of claim 6 wherein at least one of said shell sections is provided with an elongated straight longitudinal disposed recess for rotatably holding said crankshaft.

8. The marker buoy of claim 7 wherein said recess is further defined as being formed by interior, parallel flange walls which depend downwards from an outer wall surface of one of said shell sections.

9. The marker buoy of claim 8 further including a circular retaining boss attached coaxially to said crankshaft, said retaining boss being constrained against longitudinal movement by contact with opposed parallel opposed walls of a transverse recess, said transverse recess being perpendicular to said longitudinally disposed recess and lying between said inner and outer flange walls.

10. The marker buoy of claim 9 wherein said upper and lower shell sections are interiorly mirror symmetric to one another.

11. The marker buoy of claim 10 wherein said upper and lower shell sections have in plan view the shape of a polygon.

12. The marker buoy of claim 11 wherein said central aperture is concentric with said outer flange walls.

13. The marker buoy of claim 12 wherein said polygon is a rectangle.

14. The marker buoy of claim 13 wherein said outer wall surfaces of said shell sections are generally flat and perpendicular to said outer flange walls.

* * * * *